United States Patent [19]

Koshizuka et al.

[11] Patent Number: 4,774,128

[45] Date of Patent: Sep. 27, 1988

[54] THERMAL TRANSFER RECORDING MEDIUM

[75] Inventors: Kunihiro Koshizuka; Takao Abe; Yoshihiro Inaba; Tatsuichi Maehashi, all of Hino, Japan

[73] Assignee: Konishiroku Photo Industry Co., Ltd., Tokyo, Japan

[21] Appl. No.: 787,530

[22] Filed: Oct. 15, 1985

[30] Foreign Application Priority Data

| | | | |
|---|---|---|---|
| Oct. 19, 1984 | [JP] | Japan | 59-218279 |
| Jan. 11, 1985 | [JP] | Japan | 60-2026 |
| May 8, 1985 | [JP] | Japan | 60-98493 |

[51] Int. Cl.[4] ..... B41M 5/26

[52] U.S. Cl. ..... 428/212; 428/195; 428/323; 428/327; 428/412; 428/414; 428/423.1; 428/480; 428/484; 428/488.1; 428/500; 428/522; 428/523; 428/913; 428/914

[58] Field of Search ..... 428/195, 484, 488.1, 428/488.4, 913, 914, 212, 323, 327, 336, 339, 411.1, 412–414, 423.1, 480, 500, 522, 523

[56] References Cited

U.S. PATENT DOCUMENTS

| | | | |
|---|---|---|---|
| 4,572,860 | 2/1986 | Nakamura et al. | 428/484 |
| 4,617,224 | 10/1986 | Hotta et al. | 428/484 |

FOREIGN PATENT DOCUMENTS

| | | | |
|---|---|---|---|
| 0096992 | 6/1984 | Japan | 428/914 |
| 0165690 | 9/1984 | Japan | 428/914 |
| 0169892 | 9/1984 | Japan | 428/914 |
| 0061290 | 4/1985 | Japan | 428/914 |

*Primary Examiner*—Bruce H. Hess

*Attorney, Agent, or Firm*—Frishauf, Holtz, Goodman & Woodward

[57] ABSTRACT

Disclosed is a thermal transfer recording medium comprising (i) a support, (ii) an adhesion layer formed on said support and (iii) a heat-fusible colorant layer formed on said adhesion layer and containing a colorant and a heat-fusible substance; said heat-fusible colorant layer containing a polyoxyethylene type compound having in the molecule at least one polyoxyethylene chain moiety represented by $-(O-CH_2-CH_2)_n-$ wherein n is an integer of 2 or more.

According to the medium of this invention, repeated uses are possible and images with high density can be obtained when a transfer paper with low surface smoothness or a transfer paper with high surface smoothness is employed.

25 Claims, No Drawings

THERMAL TRANSFER RECORDING MEDIUM

BACKGROUND OF THE INVENTION

This invention relates to a thermal transfer recording medium, more particularly to a thermal transfer recording medium resistant to repeated uses.

In recent years, the techniques in letter printing recording have progressed from the impact recording employing a pressure-sensitive ribbon of the prior art to non-impact recording which enables lowering in printer cost, removal of noise and alleviation in maintenance. Among various non-impact recording methods, the thermal transfer recording method is not only excellent in the above requirements but it is also of interest with respect to the advantages such as stability of the image, reliability, etc.

However, in the thermal transfer recording under the present situation, the ribbon has no resistance to repeated uses, and the greatest problem to be solved is lowering in running cost. Thus, development of a thermal transfer recording medium resistant to repeated uses which can take the place of the one time ribbon has been desired. Some techniques for this purpose have hitherto been disclosed.

For example, Japanese Unexamined Patent Publication No. 68253/1969 discloses a method in which a fine porous layer of a resin component is formed by use of a volatile solvent and the ink is permitted to be oozed out through thermal fusion from the heat-fusible colorant layer (hereinafter referred to merely as the colorant layer) with the use of said resin component as the solid matrix, and Japanese Unexamined Patent Publication No. 105579/1980 discloses a method in which a heat-fusible ink is incorporated into a colorant layer having similarly the heat-resistant microporous reticulate structure, and a polymer with a heat resistant temperature of 120° C. or higher is employed as the solid matrix.

Also, Japanese Unexamined Patent Pubication No. 160691/1982 discloses a method in which an ink employing a solvent dye as a colorant in an inorganic or organic fine powder (e.g. carbon black) as the solid matrix is permitted to be oozed out.

Further, Japanese Unexamined Patent Publication No. 185192/1982 discloses a method in which an ink is impregnated into a porous paper as the solid matrix and permitted to be oozed out through thermal fusion.

Any of these techniques is based on the concept of having an ink oozable by heating existed in a porous solid matrix and being transferred little by little from the colorant layer. Such a concept utilizes, for example, the technique of the carbon paper for pressure-sensitive transfer as disclosed in Japanese patent Publication No. 13426/1960 for the carbon paper for thermal transfer.

However, in the case of thermal transfer, the presence of the solid matrix for transferring little by little the ink can be at the same time another great drawback.

That is, during application of energy, the solid matrix itself will not be fused or mixed, thus being substantially non-transferable. By containing such a non-transferable material within the colorant layer, the colorant layer as a whole is made thicker and the transfer efficiency per unit volume of the colorant layer will be lowered. Consequently, there may be induced lowering in sensitivity, lowering in letter printing speed, lowering in density of the transferred image, excessive load on the thermal head or deterioration of printed letter quality such as resolution, etc. Accordingly, development of a recording medium resistant to repeated uses without use of a solid matrix has been desired, and its basic performance is that the colorant layer and the support must have sufficient adhesive force to satisfy at least the requirement that the whole thickness layer of the colorant layer should not be transferred all at once.

As the techniques for this purpose, pressure-sensitive sheets have been known for a long time, but also in the field of thermal transfer, techniques interposing adhesion layers are disclosed in Japanese Unexamined Patent Publications Nos. 68253/1979, 105579/1980, 36698/1982 and 96992/1984.

However, as described above, when no solid matrix is employed, only interposition of an adhesion layer can hardly control in an adequate manner the amount of ink transferred.

More specifically, according to the investigations by the present inventors, by only combining the basic materials to be generally employed in one time ribbon of the prior art, for example, various waxes, various colorants such as carbon black, pigment, low softening resins, softeners {oily or semi-solid substances (normal temperature) such as castor oil, mineral oil, hydrogenated vegetable oil, white petrolatum, lanolin, hydrophilic petrolatum, etc.} and incorporating them in the colorant layer, the amount of ink transferred cannot adequately be controlled. For example, when the colorant layer is attempted to be softened by using in combination a softening agent which is semi-solid or oily at room temperature and a solid heat-fusible substance, the amount of ink transferred cannot be optimized for various kinds of transfer papers. Also, while it is useful to impart film forming property with a low softening resin similarly as in the case of one time ribbon, or ensure adhesive force with the lower layer, such measures cannot make the recording medium competent enough to give high quality printed letters of high density on any transfer paper and yet make it resistant to repeated uses.

Although for example, even letter printing can be repeated for a large number of times on a paper with high Bekk smoothness, for a paper with low Bekk smoothness, the amount of transfer for the first time may be too much, whereby the density of the printed letter of the second time or thereafter may be lowered.

Alternatively, if it is desired to obtain an appropriate number of letter printing on papers with low smothness, there will ensue the problem such that the amount of transfer is too small for one time and the density is too low in cases of a paper with high smoothness.

Moreover, there are also involved problems, irrespectively of the smoothness of the transfer paper, such that the density is essentially low or that the quality of printed letter is bad.

SUMMARY OF THE INVENTION

An object of the present invention is to provide a thermal transfer recording medium resistant to repeated use which is capable of giving images of high density on either a transfer paper with low surface smoothness or a transfer paper with high surface smoothness.

Another object of the present invention is to provide a thermal transfer recording medium resistant to repeated uses which is high in sensitivity as well as in resolution, and can give printed letters of good quality.

Still another object of the present invention is to provide a thermal transfer recording medium resistant to repeated uses, which is inexpensive in the production cost for coating of the ink layer.

Still another object of the present invention is to provide a thermal transfer recording medium which can suppress generation of blocking or ground staining to the minimum extent and can obtain a medium density by selection of the energy to be applied.

The above objects of the present invention can be accomplished by a thermal transfer recording medium comprising (i) a support, (ii) an adhesion layer formed on said support and (iii) a heat-fusible colorant layer formed on said adhesion layer and containing a colorant and a heat-fusible substance, said heat-fusible colorant layer containing a polyoxyethylene type compound to be constituted as resistant to repeated uses.

As preferable embodiments of the present invention, there may be included:

(1) an embodiment wherein the above colorant layer contains at least one selected from the heat-fusible substances of the group A shown below:

the group A: heat-fusible waxes of animal type, vegetable type, mineral type, petroleum type and synthetic hydrocarbon type and modified type;

(2) an embodiment wherein the above colorant layer contains a low softening point resin;

(3) an embodiment wherein the melt viscosity of the composition of the above colorant layer is controlled to be 30 to 900 c.p. at 100° C.;

(4) an embodiment wherein the above polyoxyethylene type compound contains a $\text{-}(\text{O}\text{—}\text{CH}_2\text{—}\text{CH}_2)_n\text{-}$ moiety with a weight average molecular weight of 2000 to 20000, particularly 4000 to 18000, in the molecule; and (5) an embodiment wherein the above polyoxyethylene type compound contains a $\text{-}(\text{O}\text{—}\text{CH}_2\text{—}\text{CH}_2)_n\text{-}$ moiety with a weight average molecular weight of 40 to 300.

DETAILED DESCRIPTION OF THE INVENTION

The ink as mentioned in the present invention refers to a composition contained in the colorant layer, which is to be oozed out from the colorant layer by thermal fusion.

According to the study by the present inventors, the amount of the ink transferred onto the transfer paper may be considered to be dependent on physical properties of the ink and the transfer paper such as the viscosity of the molten ink, repellency of the colorant layer from the adhesion layer (so called cohesive destructability in the colorant layer), and further thermal expansion, surface tension of the ink and others.

When these parameters are combined and designed for optimization based on experiments, a specific development of successive transfer from the upper part of the colorant layer will occur during repeated uses, and yet the dependency of the transfer density on the surface smoothness of the transfer paper can be suppressed to a minimum.

This may be considered to be determined by mutual cohesive force between the compositional materials constituting the ink, and by the balance in overall mechanics such as the viscosity which will influence difficulty or easiness in transfer, magnitude of cohesive destructability in the above colorant which will control the amount of transfer, wetting area or wetting volume of the transfer paper for receiving the ink, thermal expansion and surface tension of the ink as the transfer driving force, the cooling solidifying speed of the ink with which specific heat, etc. is concerned, conditions for pressure contact, peel-off, etc. of the recording medium (ink ribbon) having the colorant layer.

Accordingly, by merely combining the materials in general of the prior art as described above, it is almost impossible to accomplish designing for optimization which is resistant to repeated uses and can realize high density transfer; and therefore specific materials are required to be selected and combined.

As the result of intensive studies made by the present inventors, it has been found to be possible to control sufficiently the mutual cohesive force and maintain at the same time the adhesive force of the adhesion layer without impairment of the necessary minimum extent of film forming property by combining a relatively nonpolar wax selected from the above group A and a substance such as the polyoxyethylene type compound according to the present invention which is relatively polar and has a specific miscibility with the group A and by incorporating them into the colorant layer.

The mutual cohesive force is originated from the intermolecular mutual actions between the compounds contained in the colorant layer. Accordingly, the magnitude of the mutual cohesive force may be considered to vary depending on the kind of the polar group in the molecule and the molecular weight, or more macroscopically on the structure and its presence of the sea-island texture based on immiscibility between the compounds.

The present invention aims to control the cohesive force by the combination of the above group A with polyoxyethylene type compounds.

Also, in the present invention, use of a small amount of low melting resin is particularly preferred as the method for optimization of the visocity of the ink layer as a whole in the sense that the film forming property of the colorant layer and the adhesive force between the colorant layer and the adhesive force can be ensured and also in that the transferred amount can be controlled. In particular, when letter printing is to be effected for a large number of times on transfer papers with low surface smoothness, a viscosity of the ink layer may preferably be 30 to 900 centipoise. If the viscosity is higher than this range, blurring or lowering in density of printed letters will be induced, whereby it is difficult to optimize the transferred amount only by controlling the mutual cohesive force between the above group A wax and polyoxyethylene type compound. On the other hand, if the viscosity is too low, resolving power may be lowered or letter printing at high density for a large number of times can be done with difficulty.

Japanese Unexamined Patent Publication No. 129094/1983 discloses that the printed letter quality can be improved by incorporating a polyvalent alcohol in the colorant layer in the ink ribbon for one time and transferring the total amount of ink in the colorant layer. In contrast, in the present invention, the adhesion layer suppresses transfer of the ink by controlling the adhesive force at the interface between the colorant layer provided thereon and the support, thereby showing the effect of affording resistance to repeated uses while giving necessary and sufficient amount of transferred ink. Thus, the present invention is entirely different in its action and effect as well as the technical thought from the above disclosed technique.

The polyoxyethylene type compound according to the present invention is a compound having at least one polyoxyethylene chain moiety of the formula shown below in the molecule:

$$-\!\!\left(OCH_2CH_2\right)_n\!\!- \quad \text{(n: integer of two or more)}$$

Said compound preferably has a melting point of 30° to 120° C. based on JIS K 2523 or a softening point of 40° to 180° C. based on Ball and Ring method according to JIS K 2207. More preferably, it has a melting point of 40° to 100° C. (JIS K 2523) or a softening point of 45° to 160° C. (Ball and Ring method according to JIS 2207).

The weight average molecular weight of the polyoxyethylene chain moiety of $-\!\!\left(OCH_2CH_2\right)_n\!\!-$ in the molecule of said compound, or when having a plurality of polyoxyethylene chains in the molecule, the total of weight average molecular weight thereof (hereinafter referred to as total weight average molecular weight) is an important factor which determines the transfer amount. The transfer amount, which must be adequate for various kinds of transfer papers and may differ depending on the molecular weight of said compound or the portion other than the polyoxyethylene moiety, may be described as follows.

A compound with a total weight average molecular weight of the polyoxyethylene moiety of 2000 to 20000 may preferably be employed in obtaining high density printed letters for a large number of times due to a relatively larger transfer amount used for one transfer. Of the above compounds, a compound with a total weight average molecular weight of the polyoxyethylene moiety of 4,000 to 18,000 is particularly preferable.

Also, on the other hand, a compound with a total weight average molecular weight of 40 to 300 enables use of a transfer paper with low Bekk smoothness to give good printed letter quality for a large number of times.

Of course, a compound with a total weight average molecular weight of the polyoxyethylene moiety over 300 and lower than 2000 may also have the same effect, but it is preferred that the total weight average molecular weight of the polyoxyethylene moiety should be 4 to 300 and 2000 to 20000.

Particularly, the effect obtained by a compound with a total weight average molecular weight of 2000 to 20000 (further, particularly preferalby, 4000 to 18000) is surprising, and such a compound may preferably be employed in the present invention. This may be attributable to miscibility with the group A to be selected.

The above weight average molecular weight is based on GPC method.

The polyoxyethylene type compound of the present invention may be contained in the colorant layer in a dispersed state, a mixed state on molecular level or a pseudo-mixed state depending on its amount, polarity or miscibility with the group A wax to be selected.

In the present invention, it is particularly preferred that the polyoxyethylene type compound should be contained in a dispersed state, namely, as non-continuous sea-island structure in the continuous layer of the compounds other than the polyoxyethylene type compound, including the wax selected from the group A.

However, the polyoxyethylene type compound may also form a continuous layer and the group A wax form sea-island structure.

The effect of the present invention can also be exhibited, even when no clear dispersed state may be formed, namely in a pseudo-mixed state or in a mixed state. The dispersing means is not particularly limited, but when the compound is immiscible with the above group of wax compounds, dispersing can be effected by, for example, vigorous stirring.

The dispersed state may also be formed intentionally during coating by use of an organic solvent.

For example, a dispersing machine such as dissolver, mixer, sand grinder or ball mill can be used. The particle size of dispersion can be varied depending on various factors such as the dispersing method, etc., but it is preferred in the present invention that the dispersion particle size should be 10 μm or smaller.

In the present invention, the dispersed state of said compound in the colorant layer can be examined simply by observing the colorant layer composition under hot melted condition from which the colorant has been removed or under coated condition. When sea-island structure, white turbidity, liquid droplet (oil droplet) state or phase separation state is found to be formed in this observation, said compound may be judged to be enriched in immiscibility.

In the present invention, a dispersed state can preferably be formed with ease when the compound is enriched in immiscibility as mentioned above.

To refer further to immiscibility, miscibility of the group A wax with said polyoxyethylene type compound can be examined as follows. For example, by use of the miscibility of the group A wax with fluid paraffin as a representative value of the group A wax (for example, at 10% concentration), the group A wax can be classified into the three kinds of:

(a) those which are immiscible with fluid paraffin at any temperature;

(b) those which are miscible at higher than 40° C., but immiscible at lower than 40° C.;

(c) those which are miscible at any temperature, and (a) and (b) are preferred in view of resistance to repeated uses and productivity.

However, even (c) can of course exhibit the effect of the present invention.

The polyoxyethylene type compound according to the present invention means a compound having at least one polyoxyethylene moiety in the molecule as defined above. To describe in more detail, it can be classified into polyethylene glycol and polyethylene glycol derivatives.

Among them, particularly polyethylene glycol derivatives are to be described below.

In derivation of the derivatives, one or two of the alcoholic —OH groups of polyethylene glycol are allowed to react with various organic compounds. In this case, a variety of bondings may be possible, including, typically ether bonding, ester bonding, and bonding with a sulfur atom or a nitrogen atom, urethane bonding and others. For the present invention, the form of bonding for derivation can be no crucial problem and is not particularly limited.

It is rather preferable to carry out derivation on the basis of a molecular design (of molecular weight, miscibility with the group A wax and the number of polar groups, etc.) so that the blocking performance, prevention of bleed-out, cohesive destructive force and viscosity may be optimized. However, as a representative example of derivation, there may be mentioned ether derivation and ester derivation.

Next, specific examples of particularly preferable polyoxyethylene type compounds in the present invention are set forth below. The preferable range of the weight average molecular weight of the polyoxyethylene chain moiety is 2000 to 20000, but when having a plurality of polyoxyethylene chains in the molecule, the total of weight average molecular weight thereof should preferably fall within the above range of 2000 to 20000 as mentioned above.

(1) Polyethylene glycol:

Polyethylene glycols with weight average molecular weight of the $-(CH_2CH_2O)_n-$ moiety of 20000, 12000, 9000, 6000, 1000, 400 and 100 and diethylene glycol are included as specific examples.

(2) Mono- or di-ester derivatives of polyethylene glycol: Particularly when derived from fatty acids, said fatty acids may preferably have 10 to 50 carbon atoms, more preferably 19 to 50 carbon atoms.

More specifically, there may be included mono- or di-ester derivatives of polyethylene glycol derived from various organic acids, including preferable capric acid, undecanoic acid, lauric acid, tridecanoic acid, myristic acid, pentadecanoic acid, palmitic acid, margaric acid, stearic acid, more preferably nonadecanoic acid, arachic acid, heneicosanoic acid, behenic acid, tricosanoic acid, lignoceric acid, and the like.

Typical examples may include straight mono-ene acids, di-, tri- or tetra-ene acids, synthetic fatty acids, tertiary fatty acids, branched fatty acids, dimer acids, dibasic acids, polybasic acids, oxycarboxylic acids, fatty acid chlorides, fatty acid anhydrides, polycarboxylic acids and other compounds having a single or plural number of carboxylic groups in the molecule.

Polyethylene glycol diesters have better dispersing characteristics as compared with polyethylene glycols or polyethylene glycol monoesters and also exhibit the effect of not deteriorating dispersibility of the colorant. Further, they exhibit the effects of giving stable high density, and also high density and high printed letter quality even in the case of letter printing for repeated times or when employing a paper with low surface smoothness. Thus, polyethylene glycol disters are preferred as said compound of the present invention.

The dieter moieties may be either the same or different.

Specific examples

Polyethylene glycol monobehenate (PEG 4000)
Polyethylene glycol distearate (PEG 6000)
Polyethylene glycol monopalmitate (PEG 600)
Polyethylene glycol dibehenate (PEG 14000)
Polyethylene glycol laurinate (PEG 100)

[In the brackets are shown the weight average molecular weights of $-(CH_2CH_2O)_n-$ moiety (PEG moiety). The same notations are also shown in the brackets given hereinafter.]

(3) Monoalkyl-, arylalkylaryl ether derivatives of polyoxyethylene ether (compounds having one —OH group of polyethylene glycol converted to an ether derivative):

The above ethers are polyoxyethylene ethers of alkyls or alkylaryls having preferably 6 or more carbon atoms, particularly preferably 18 to 50 carbon atoms.

The alkyls may be either straight or branched hydrocarbons. Alternatively, they can also be halides of these.

Further, as special cases, they can be polyoxyethylene ethers of unsaturted hydrocarbons, synthetic alcohols, oxycarboxylic acids, nitrogen-containing or sulfur-containing compounds.

Specific examples

Polyethylene glycol mono-p-nonylphenyl ether (PEG 900)
Polyethylene glycol monobehenyl ether (PEG 6000)
Polyethylene glycol monocetyl ether (PEG 200)
Polyethylene glycol monooleyl ether (PEG 4000)

(4) Ether or ester derivative of the monoether derivative of (3):

The monoalkyl, arylalkylaryl ether derivative of polyoxyethylene ether of the above (3) in which the residual —OH group is converted into an ether derivative or an ester derivative.

In this case, ester derivation is similar to the case of (2), and ether derivation similar to the case of (3).

Specific examples

Monobehenate of polyethylene glycol mono-p-nonylphenyl ether (PEG 800)
Monostearate of polyethylene glycol monostearyl ether (PEG 9000)
Polyethylene glycol dibehenyl ether (PEG 6000)
Polyethylene glycol monooleyl ether monobehenyl ether (PEG 4000)

(5) Polyoxyethylene ether derivative of polyhydric alcohol:

The title compound is a compound having two or more alcoholic OH group in the molecule, for example, glycerine, polyglycerine, propylene glycol, pentaerythritol, polypropylene glycol, sorbitan (1,5-sorbitan, 1,4- or 3,6-sorbitan, isosorbide), mannitol or otherwise a Poval with a molecular weight of 800 or less, and further a polyoxyethylene ether derivative in which one or two or more of the alcoholic OH group in the molecule are subjected to ether and/or ester derivation according to (2) and/or (3).

Said polyoxyethylene ether derivative may have a single number or plural number of polyoxyethylene chains in the molecule.

Also, one end of the polyoxyethylene chain of said polyoxyethylene ether derivative may preferably be converted into ester and/or ether.

In the present invention, said polyvalent alcohol may also have a structure in which two or more sets of polyvalent alcohols are combined, or a structure crosslinked with a polyoxyethylene chain.

Specific examples

Polyoxyethylene monostearate of glycerine
Di(polyoxyethylene monostearate) of glycerine
Polyoxyethylene monobehenyl ether of sorbitan monobehenate
Polyoxyethylene ether of batyl alcohol
Polyoxyethylene oleate of propylene glycol monooleate
Block copolymer of polypropylene glycol and polyoxyethylene glycol
Polyoxyethylene ether of polystearate of polyglycerine
Polyoxyethylene ether behenate of pentaerythritol distearyl ether
Polyoxyethylene ether of sorbitane ester
Polyoxyethylene ether of pentaerythritol
Polyoxyethylene ether of polyglycerine ester
Ester of polyoxyethylene ether of batyl alcohol ester
Polyoxyethylene ether of mannitol ester (6) Polyoxyethylene derivative of a molecule containing sulfur atom or nitrogen atom:

As specific examples, alkylthiopolyoxyethylene ether, polyoxyethylene fatty acid amide, polyoxyethylene alkylamine, etc. may be included.

(7) Polyoxyethylene derivative of polymer or copolymer:

For example, there may be included alkylaryl formaldehyde condensed polyoxyethylene ether, polyoxyethylene ether ester of copolymer, polyoxyethylene ether derivative of α-olefin-maleic anhydride copolymer.

(8) Block polymer of polyoxyethylene and a synthetic polymer such as polyester and polyurethane.

(9) Compounds with anionic properties:

For example, there may be included anionic surfactants containing polyoxyethylene such as carboxylates of polyoxyethylene alkyl (aryl) ethers, sulfates of polyoxyethylene fatty acid esters, sulfates of polyoxyethylene alkyl (aryl) ethers, phosphates of polyoxyethylenealkyl (aryl) ethers, phosphates of polyoxyethylenealkyl (aryl) amides, carboxylates of polyoxyethylene fatty acid esters.

(10) Compounds with cationic properties:

For example, there may be included cationic surfactants containing polyoxyethylene such as alkyl (aryl) polyoxyethylene ether ammonium salts, polyoxyethylene hydroxyammonium salts, etc. and amphoteric surfactants (in this case, no cationic property is possessed).

The amount of the ethylene oxide type solid compound added to be used in the present invention may differ depending on the heat-fusible substance and the combination of another binder (in the present invention, binders other than the above heat-fusible substance can be used) with the ethylene oxide type solid compound. However, since it may partially be dissolved in some cases, an amount by which the oxide and the heat-fusible substance are incompatible with each other is required to be used, preferably 3% or more, more preferably 6% or more. At a level less than 3%, depending on the combination, no large number of letter printing may be possible. Also, for the reasons of making the dispersion system stable, imparting a strength of the film of an ink layer and improvement of fixing characteristic after letter printing, said amount should preferably be 60% or less, more preferably 50% or less.

Next, the heat-fusible substance of the group A according to the present invention (animal type wax, vegetable type wax, mineral type wax, petroleum type wax, synthetic hydrocarbon wax and modified wax) is to be explained.

The group of wax compounds to be used in the present invention may include solid waxes which are solid at room temperature, preferably having melting points of 40° to 80° C. (as measured by Yanagimoto MPJ-2 Model), specifically those as mentioned below. As the animal type wax, there may be included beeswax, insectwax, shellac wax, whale wax, wool wax, etc.; as the vegetable type wax, carnauba wax, woodwax, auricuri wax, espalt wax, candellila wax, etc.; as the mineral type wax, montan wax, ozocerite, ceresin, etc.; as the petroleum type wax, paraffin wax, microcrystalline wax, ester wax, petrolatum, etc.; as the synthetic hydrocarbon type was, Fischer-Tropsch wax, polyethylene wax, low molecular weight polypropylene, low molecular weight polyethylene and derivatives thereof; as the modified wax, oxidized wax, montan wax derivative, paraffin or microwax derivative, etc. These may be used either singly or as a combination of two or more kinds. In the present invention, it is also possible to use in combination a wax which does not belong to the above group of wax compounds such as hyrogenated wax, for example, castor wax, opal wax, etc. and copolymers of α-olefin with maleic anhydride.

The wax of the group A should preferably be employed as a continuous binder layer in the colorant layer.

The colorant to be used in the heat-fusible colorant layer of the present invention may suitably be selected from various kinds of dyestuffs, preferably from among direct dyes, acidic dyes, basic dyes, disperse dyes, oil-soluble dyes (including metal-containing oil-soluble dyes), etc. The dyestuff to be used in the colorant layer of the present invention may be any dyestuff which can be transferred (migrated) together with the heatfusible substance, and therefore pigments may also be included in addition to those as mentioned above. Specifically, the following dyestuffs may be included. That is, as yellow dyestuffs, Kayaron Polyesterato Yellow 5G-S (Nippon Kayaku), Oil yellow-S-7 (Hakudo Chemical research institute), Eisenspiron Yellow GRH Special (Hodogaya Chemical Co., Ltd.), Sumiplast Yellow FG (Sumitomo Chemical Company, Limited), Eisenspiron Yellow GRH (Hodogaya Chemical Co., Ltd.), etc. may preferably be employed. As red dyestuffs, Diaseriton Fast Red R (Mitsubishi Kasei), Dianicks Brilliant Red BS-E (Mitsubishi Kasei), Sumiplasto Red FB (Sumitomo), Sumiplast Red HFG (Sumitomo), Kayaron Polyester Pink RCL-E (Nippon Kayaku Co., Ltd.), Eisenspiron Red GEH Special (Hodogaya), etc. may preferably be employed. As blue dyestuffs, Diaseriton Fast Brilliant Blue R (Mitsubishi Kasei), Dianicks Blue EB-E (Mitsubishi Kasei), Kayaron Polyester Blue B-SF Conc. (Nippon Kayaku), Sumiplast Blue 3R (Sumitomo), Sumiplast Blue G (Sumitomo), etc. may preferably be used. Indoaniline dyes, azomethine dyes used for photography may also preferably be employed. Also, yellow pigments may include Hanza Yellow 3G, Taltrazine Lake, etc.; red pigments may include Brilliant Carmine FB Pure (Sanyo Shikiso), Brilliant Carmine 6B (Sanyo Shikiso), Alizarine Lake, etc.; blue pigments may include Cerlean Blue, Sumicaprint Cyanine Blue GN-O (Sumitomo), Phthalocyanine Blue, etc.; and black pigments may include carbon black, oil black, etc. Among the colorants to be used in the present invention, the most preferred is carbon black.

It is particularly preferable to incorporate a resin with lower softening point in the colorant layer of the present invention for controlling its viscosity and cohesive force.

As said resin with lower softening point, there may be included polymers with a softening point (ring-ball method) of less than 110° C. for prevention of lowering of sensitivity.

In the present invention, the resin component need not serve as the solid mother material (non-transferable), and thus it is preferred that the resin is miscible with the wax binder of the group A and also that its amount should be small. It should be added in an amount preferably of 1% or more and less than 20% based on the whole colorant layer. Since it is miscible with the wax binder of the group A, it can be applied on the colorant layer with no solvent.

Specifically, there may be included polyethylene or ethylene copolymers such as ethylene-ethyl acrylate copolymer, ethylene-vinyl acetate copolymer and α-olefin polymers such as polypropylene or copolmers thereof, polystyrene, and rubbers such as styrene-butadiene, styrene-isoprene copolymers, polybutadiene, etc.

On the other hand, it is not preferable to use poyamide, gelatin, polyvinyl alcohol, vinyl chloride-vinyl acetate copolymer, polyvinylidene chloride, polyvinyl acetate, etc., since they are immiscible with the wax binder of the group A, and forced to employ a volatile solvent.

The adhesion layer according to the present invention means a layer which exists on the support and has a function to ensure adhesive force between the support and the colorant layer.

In order for said adhesion layer to fulfill its function, it should preferably be composed of a resin component or a resin as its main component.

In the present invention, it is determined by the balance with the cohesive force of the colorant layer positioned as its upper layer whether the adhesive force is sufficient or not therefore it cannot equally be expressed.

In other words, it is required for resistance to repeated uses that the adhesive force between the support and the colorant layer should surpass at least the mutual cohesive force of the colorant layer, and such a mechnical balance will be changed depending on the method by which the ink ribbon is peeled off from the transfer paper or the temperature during such an operation.

Such a performance can be examined by, for example, the peeling test in which a tacky tape is plastered on the colorant layer and peeled off.

Said adhesion layer should preferably have a softening point (melting point) of 50° C. at the lowest, more preferably 70° C. or higher.

Also, the thermal conductivity of said adhesion layer should preferably be as high as possible.

Said adhesion layer should preferably have a film thickness of 0.1 to 5.0 μm, more preferably 0.3 to 3 μm, and it is preferred to be as thin as possible, provided that the adhesive force is sufficient.

As the method for providing the adhesion layer, there may be employed those known in the art such as gravure coating, extrusion coating, roll coating, wire bar coating, dip coating, etc.

The form of the coating liquid may be selected from among those known in the prior art for coating of resins such as hot melt, aqueous solution, aqueous latex solution, organic solvent solution.

The resin to be used for the above adhesion layer may be either thermoplastifiable or thermosetting.

Preferable examples of compounds may include acrylic resin, ethylene-vinyl acetate resin, vinyl acetate resin, polyethylene resin, polyurethane resin, phenoxy resin, polyvinyl butyral resin, polycarbonate, polyester resin, epoxy resin, ethylene-ethyl acrylate resin and so on.

The present invention is described by referring to the following Examples, by which the present invention is not limited at all. In the following Examples, "parts" indicate "parts by weight".

EXAMPLE 1

A polyethyleneterephthalate film with a thickness of 5.6 μm was coated with a solution of an ethylene-ethyl acrylate resin (NUC-6070, produced by Nippon Unicar K.K.) by a wire bar to a dried film thickness of 0.5 μm to obtain an adhesion layer thereon and, after drying, hot melt coating of the colorant layer coating liquid (hot melt dispersion by use of dissolver) was applied by a wire bar to a film thickness of 12 μm, followed by heating in a dryer at 100° C. for 12 minutes, to obtain a thermal transfer recording medium sample (1) of the present invention (in shape of a ribbon with 8 mm width).

Colorant layer coating liquid:

| | |
|---|---|
| Carnauba wax | 20 parts |
| Paraffin wax (m.p. 75° C.) | 10 parts |
| Microcrystalline wax (m.p. 78° C.) | 15 parts |
| Oxidized wax | 10 parts |
| Carbon black | 15 parts |
| Bees wax | 10 parts |
| Compound X (indicated in Table 1) | 20 parts |

The thermal transfer recording medium sample (1) was subjected to recording on a plain paper (letter printing) by means of a Serial Thermal Printer (a trial machine mounted with a thin film type serial head having a heat-generating element density of 8 dot/mm) by giving an appliction energy of 1.0 mj/dot. This operation was repeated three times, and the optical reflective density after solid letter printing was determined. As the plain paper, commercially available pure paper and rough paper were employed. The results are shown in Table 1.

TABLE 1

| Sample | Optical Reflective Density — Paper for printing: 200"*; High smoothness | 67"*; Medium smoothness |
|---|---|---|
| X = Polyethylene glycol (Mw = 6000) (Sample of Invention) | 0.75, 0.73, 0.73 Good print quality for 3 times | 0.90, 0.84, 0.80 |
| X = Polyethylene wax (Control sample) | >2.0 ≈0, ≈0 | >2.0, ≈0, ≈0 |
| X = Carnauba wax (Control sample) | >2.0 ≈0, ≈0 | >2.0, ≈0, ≈0 |

Note
Print density is shown in the order of printing from left to right.
*Bekk smoothness As shown in the Table, when polyethylene glycol was added, the print density could be kept almost constant for a large number of printing times, in the case of a smoothness of 200" or 67".

When this was not added, printing could be done substantially only once.

EXAMPLE 2

Example 1 was repeated with the use of the following recipe:

| | |
|---|---|
| Polyethylene wax | 10 parts |
| Paraffin wax | 30 parts |
| Oxidized wax | 10 parts |
| Montan modified wax (Hoechst E) | 10 parts |
| Carbon black | 15 parts |
| Ethylene-ethyl acrylate resin | 10 parts |
| Compound X (indicated in Table 2) | 15 parts |

The results are shown in Table 2.

TABLE 2

| Sample | Optical Reflective Density — Paper for printing: 200"; High smoothness | 39"; Low smoothness |
|---|---|---|
| X = Polyethylene glycol dibehenate (Mw 7000) (Sample of Invention) | 1.01, 1.05, 0.98 | 0.98, 0.98, 0.96 |
| X = Polyethylene glycol dibehenate (Mw 7000) Adhesive layer removed | >2.0 ≈0, ≈0 | >2.0, ≈0, ≈0 |

TABLE 2-continued

| Sample | Optical Reflective Density: Paper for printing 200"; High smoothness | 39"; Low smoothness |
|---|---|---|
| (Control sample) X = Bees wax (Control sample) | 0.69, 0.60, 0.52 | 1.20, 0.61, 0.48 |

As shown in the above Table, letter printing with high density may be possible when the surface smoothness may be high or low. In contrast, in absence of an adhesion layer, letter printing can be effected substantially only once.

On the other hand, when beeswax is employed in place of polyethylene glycol dibehenate, particularly when a transfer paper with low Bekk smoothness was employed, lowering in density of transfer was large. Also, even when the Bekk smoothness was high, the transfer density was small, and the quality of printed letter was not good.

Blocking characteristics of Sample (1) and Sample (3) were also examined.

Blocking test was carried out by laminating the sample on a polyethyleneterephthalate film, applying a load of 17 g/cm$^2$ thereon, followed by leaving to stand under the conditions of 45° C., 20% RH for 2 days. Then, the sample was peeled off for examination of the antiblocking property. As the result, (1) was completely free from blocking, but (3) was found to suffer from blocking with the polyethyleneterephthalate film laminated being whitened after peel-off of the sample.

EXAMPLE 3

Example 1 was repeated by use of the following recipe:

| | |
|---|---|
| Carnauba wax | 20 parts |
| Polyethylene wax | 5 parts |
| Ceresin wax | 5 parts |
| Paraffin wax | 20 parts |
| Candellila wax | 5 parts |
| Carbon black | 15 parts |
| Ethylene-vinyl acetate copolymer | 10 parts |
| Compound X (indicated in Table 3) | 20 parts |

The results are shown in Table 3

TABLE 3

| Sample | Optical Reflective Density: Paper for printing 98" | 39" |
|---|---|---|
| Mono-behenate of polyethylene glycol mono-p-nonylphenyl-ether (Mw 800) (Sample of Invention) | 0.92, 0.94, 0.86 Slight peel-off at the edge portion | 0.89, 0.85, 0.84 Slight peel-off at the edge portion |
| Polyethylene glycol monooleylether (Mw 1000) (Sample of Invention) | 0.95, 0.90, 0.91 Slight peel-off at the edge portion | 0.85, 0.90, 0.85 Slight peel-off at the edge portion |
| Polyoxyethylene ether derivative of sorbitol beeswax (Mw 220) (Sample of Invention) | 0.78, 0.78, 0.77 | 0.90, 0.91, 0.89 |
| X = Polyethylene glycol monostearyl ether monostearate (Mw 9000) (Sample of Invention) | 1.12, 1.05, 1.03 | 0.99, 0.98, 0.93 |
| X = Polyethylene glycol monoacetyl ether (Mw 200) (Sample of Invention) | 0.80, 0.78, 0.78 | 0.94, 0.90, 0.92 |
| X = Polyethylene glycol monostearate (Mw 88) (Sample of Invention) | 0.75, 0.76, 0.75 | 0.97, 0.91, 0.86 |
| X = Oxidized wax (Control sample) | 0.58, 0.50, 0.52 | 1.40, 0.54, 0.53 |
| X = Microcrystalline wax (Control sample) | 0.62, 0.55, 0.54 | 1.32, 0.48, 0.48 |
| X = Polyoxyethylene monostearate of glycerine (Mw 200) (Sample of Invention) | 0.72, 0.68, 0.69 | 0.94, 0.93, 0.91 |
| X = Copolymer of polypropylene glycol (Mw = 4000) and polyethylene glycol (Mw = 4000) (Sample of Invention) | 1.00, 0.98, 0.92 | 1.02, 0.99, 0.96 |
| X = Polyethylene glycol (Mw 6000) mono-p-nonylphenyl ether (Sample of Invention) | 1.08, 1.05, 1.00 | 0.99, 0.97, 0.98 |
| X = Polyethylene glycol (Mw 14000) monostearate (Sample of Invention) | 1.15, 1.06, 0.99 | 1.03, 0.97, 0.93 |

As shown in the above Table, by addition of various polyethylene type compounds, good print quality could be obtained for a large number of printingtimes without smear.

In contrast, in Comparative examples, not only lowering in print density was observed particularly when the Bekk smoothness was low, but also print density was low even when the Bekk smoothness was high.

When the total of molecular weights of the polyoxyethylene chain moieties is 300 to 2000, peel-off may sometimes occur slightly at the edge portion, but this is satisfactorily available, particularly in view of the fact that such an inconvenience has been found to be improved by an appropriate method for peeling of the ribbon.

On the other hand, when the molecular weight is higher than 2000, the transfer density was high to give a good print quality.

EXAMPLE 4

Example 1 was repeated by use of the following recipe:

| | | |
|---|---|---|
| Polyethyleneglycol monobehenyl ether (Mw: 9000) | | 65 parts |
| Polyethylene wax | 20 parts | |
| Candellila wax | 10 parts | |
| Microcrystalline wax | 15 parts | |
| Montan wax | 7 parts | |
| Carbon black | 13 parts | |
| Paraffin wax | | 35 parts |
| Ethylene-vinyl acetate copolymer resin | | |

The remainder of 35 parts of the composition was variously changed with paraffin wax and ethylene-vinyl acetate copolymer resin. The relationship between the viscosity of the composition and the quality of the printed letter when printed on a transfer paper with Bekk smoothness of 98" was examined to obtain the results shown in Table 4.

TABLE 4

| Sample | | Transfer paper | | |
|---|---|---|---|---|
| Paraffin | Ethylene-vinyl acetate | Viscosity (cp) | Printed letter quality 98" | Printed letter quality 39" |
| 35 | 0 | 60 | ○ | ○ |
| 27 | 8 | 160 | ◎ | ◎ |
| 20 | 15 | 430 | ◎ | ◎ |
| 13 | 22 | 830 | ◎ | ○ |
| 5 | 30 | 1020 | Δ | X |
| 0 | 35 | 1710 | X | X |

As shown in the above Table, good print quality can be obtained within the viscosity range from 30 to 900 centipoise.

If the viscosity is tqo high, deterioration in print quality may occur such as lowering in density and blurring. This tendency is particularly prominent when letters are printed onto a printing paper with low Bekk smoothness.

The print quality was evaluated by visual observation by a panel of third party of 20 members, with very clear letters (characters, hiragana, alphabet) without blurring or blotting being rated as ◎, good letters as ○, slightly inferior one as Δ, inferior ones as X. Evaluation was performed for the letter printed by the ribbon on the same place after solid printing for the first time (namely the second time printing).

Together with the advantage of accomplishing the objects of the present invention, another advantage which may also be mentioned is that the colorant layer can be subjected to hot melt coating similarly as in the case of one time.

When a solid matrix is contained, a volatile solvent must but be used during coating.

However, utilization of a volatile solvent will cause not only social problems such as pollution, environment contamination, etc. but also induce increase in production cost, thus resulting in interference with reduction in running cost, which is originally desired.

In the case of the present invention, the colorant layer can be applied by hot melt coating, whereby the production cost can be maintained at a low level and induction of social problems can also be prevented.

The method for coating of the ink layer of the present invention is not limited to hot melt coating.

We claim:

1. A thermal transfer recording medium comprising (i) a support, (ii) an adhesion layer on said support and (iii) a heat-fusible colorant layer on said adhesion layer; said heat-fusible colorant layer containing (a) a colorant, (b) a polyoxyethylene type compound having in the molecule at least one polyoxyethylene chain moiety represent by $(O—CH_2—CH_2)_n$ wherein n is an integer of 2 or more and (c) a heat fusible substance which is not a polyoxyethylene type compound; and wherein said polyoxyethylene type compound is one selected from the group consisting of:

(1) polyethylene glycol, (2) mono- or di-ester derivative of polyethylene glycol, (3) monoalkyl-, arylalkylaryl ether derivative of polyoxyethylene ether, (4) ether or ester derivative of monalkyl-, arylalkylaryl ether derivative of polyoxyethylene ether, (5) polyoxyethylene ether derivative of polyhydric alcohol, (6) polyoxyethylene derivative of a molecule containing a sulfur atom or a nitrogen atom, (7) polyoxyethylene derivative of a polymer or a copolymer, (8) polyoxyethylene derivative having anionic properties, and (9) polyoxyethylene derivative having cationic properties.

2. The thermal transfer recording medium according to claim 1, wherein the total weight average molecular weight of said $-(O—CH_2CH_2)_n$ moiety of said polyoxyethylene type compound is within the range of 2,000 to 20,000.

3. The thermal transfer recording medium according to claim 2, wherein the total weight average molecular weight of said $-(O—CH_2—CH_2)_n$ moiety of said polyoxyethylene type compound is within the range of 4,000 to 18,000.

4. The thermal transfer recording medium according to claim 1, wherein the total weight average molecular weight of said $-(O—CH_2—CH_2)_n$ moiety of said polyoxyethylene type compound is within the range of 40 to 300.

5. The thermal transfer recording medium according to claim 1, wherein said polyoxyethylene type compound has a melting point of 30° to 120° C. or a softening point of 40° to 180° C.

6. The thermal transfer recording medium according to claim 5, wherein said polyoxyethylene type compound has a melting point of 40° to 100° C. or a softening point of 45° to 160° C.

7. The thermal transfer recording medium according to claim 6, wherein said content is within the range of 6% to 50% by weight.

8. The thermal transfer recording medium according to claim 1 wherein said polyoxyethylene type compound is contained in said heat-fusible colorant layer in a dispersed state.

9. The thermal transfer recording medium according to claim 8, wherein the size of the dispersed particles of said polyoxyethylene type compound is 10 μm or less.

10. The thermal transfer recording medium according to claim 1, wherein the content of said polyoxyethylene type compound is within the range of 3% to 60% by weight based on the total amount of components in said colorant layer.

11. The thermal transfer recording medium according to claim 1, wherein said heat-fusible substance is at least one selected from the group consisting of an animal type heat-fusible wax, a vegetable type heat-fusible wax, a mineral type heat-fusible wax, a petroleum type heat-fusible wax, a synthetic hydrocarbon type heat-fusible wax and a modified type of said heat-fusible waxes.

12. The thermal transfer recording medium according to claim 11, wherein the animal type heat-fusible wax is bees wax, insect wax, shellac wax, whale wax or wool wax; the vegetable type wax is carnauba wax, woodwax, auricuri wax, espalt wax or candellila wax; the mineral type wax is montan wax, ozocerite or ceresin; the petroleum type wax is paraffin wax, microcrystalline wax, ester wax or petrolatum; the synthetic hydrocarbon type wax is Fischer-Tropsch wax, polyethylene wax, low molecular weight polypropylene, low molecular weight polyethylene or derivatives thereof;

and the modified wax is oxidized wax, montan wax derivative, paraffin or microwax derivative.

13. The thermal transfer recording medium according to claim 1, wherein said heat-fusible substance has a melting point within the range of 40° to 80° C.

14. The thermal transfer recording medium according to claim 1, wherein said colorant layer further contains a resin having a softening point less than 110° C.

15. The thermal transfer recording medium according to claim 14, wherein said resin is selected from the group consisting of polyethylene, an ethylene copolymer, an α-olefin polymer, a copolymer of an α-olefin polymer, and a rubber.

16. The thermal transfer recording medium according to claim 15, wherein the ethylene copolymer is ethylene-ethyl acrylate copolymer or ethylene-vinyl acetate copolymer; the α-olefin polymer is polypropylene or polystyrene; and the rubber is styrene-butadiene, styrene-isoprene copolymers or polybutadiene.

17. The thermal transfer recording medium according to claim 14, wherein the content of said resin is within the range of 1 to 20% based on the total amount of components in the colorant layer.

18. The thermal transfer recording medium according to claim 1, wherein said colorant is one selected from the group consisting of direct dyes, acidic dyes, basic dyes, disperse dyes, oil-soluble dyes and pigments.

19. The thermal transfer recording medium according to claim 1, wherein said adhesion layer comprises acrylic resin, ethylene-vinyl acetate resin, vinyl acetate resin, polyethylene resin, polyurethane resin, phenoxy resin, polyvinyl butyral resin, polycarbonate, polyester resin, epoxy resin or ethylene-ethyl acrylate resin.

20. The thermal transfer recording medium according to claim 1, wherein said adhesion layer has a melting point of 50° C. or more.

21. The thermal transfer recording medium according to claim 1, wherein said adhesion layer has a thickness of 0.1 to 5.0 μm.

22. The thermal transfer recording medium according to claim 21, wherein said adhesion layer has a thickness of 0.3 to 3.0 μm.

23. The thermal transfer recording medium according to claim 1, wherein the fusible viscosity at 100° C. of said colorant layer is within the range of 30 to 900 c.p.

24. The thermal transfer recording medium according to claim 1 wherein the total weight average molecular weight of said $-(O-CH_2-CH_2)_n-$ moiety of said polyoxyethylene type compound is within the range of 40 to 300, said polyoxyethylene type compound has a melting point of 40° to 100° C. or a softening point of 45° to 160° C., said polyoxyethylene type compound is contained in said heat-fusible colorant layer in a dispersed state, the size of the dispersed particles of said polyoxyethylene type compound is 10 μm or less and said polyoxyethylene type compound is in an amount of from 6 to 50% by weight based on the total amount of components in said colorant layer;

said heat-fusible substance has a melting point within the range of 40° to 80° C. and is at least one selected from the group consisting of an animal type heat-fusible wax, a vegetable type heat-fusible wax, a mineral type heat-fusible wax, a petroleum type heat-fusible wax and a synthetic hydrocarbon type heat-fusible wax and a modified type of said fusible waxes and animal type heat-fusible wax is bees wax, insect wax, shellac wax, whale wax or wool wax; the vegatable type wax is carnauba wax, woodwax, auricuri wax, espalt wax or candellila wax; said mineral type wax is montan wax, ozocerite or ceresin; said petroleum type wax is paraffin wax, microcrystalline wax, ester wax or petrolatum; said synthetic hydrocarbon type wax is Fischer-Tropsch wax, polyethylene wax, low molecular weight polypropylene, low molecular weight polyethylene or derivatives thereof; and said modified wax is oxidized wax, montan wax derivative, paraffin or microwax derivative, said colorant layer further contains a resin having a softening point less than 110° C., said resin is selected from the group consisting of polyethylene, an ethylene copolymer, an α-olefin polymer, a copolymer of an α-olefin polymer, and a rubber and said ethylene copolymer is ethylene-ethyl acrylate copolymer or ethylene-vinyl acetate copolymer; said α-olefin polymer is polypropylene or polystrene; and said rubber is styrene-butadiene, styrene-isoprene copolymers or polybutadiene; and said resin is in an amount of from 1 to 20% based on the total amount of components in the colorant layer and the fusible viscosity of 100° C. of said colorant layer is from 30 to 900 c.p.;

said colorant is one selected from the group consisting of direct dyes, acidic dyes, basic dyes, disperse dyes, oil-soluble dyes and pigments; and said adhesion layer comprises acrylic resin, ethylene-vinyl acetate resin, vinyl acetate resin, polyethylene resin, polyurethane resin, phenoxy resin, polyvinyl butyral resin, polycarbonate, polyester resin, epoxy resin or ethylene-ethyl acrylate resin, said adhesion layer has a melting point of 50° C. or more and a thickness of 0.3 to 3.0 μm.

25. The thermal transfer recording medium according to claim 24, wherein said polyoxyethylene type compound is selected from the group; consisting of polyethylene glycol,
polyethylene glycol dibehenate,
mono-behenate of polyethylene glycol mono-p-nonylphenyl ether,
polyethylene glycol monooleyl ether,
polyoxyethylene ether derivative of sorbitol beeswax,
polyethylene glycol monostearyl ether monosterate,
polyethylene glycol monoacetyl ether,
polyethylene glycol monostearate,
polyoxyethylene monostearate of glycerine,
copolymer of polypropylene glycol and polyethylene glycol,
polyethylene glycol mono-p-nonylphenyl ether,
polyethylene glycol monostearate and
polyethyleneglycol monobehenyl ether.

* * * * *